US009365038B2

(12) United States Patent
Nishikawa et al.

(10) Patent No.: US 9,365,038 B2
(45) Date of Patent: Jun. 14, 2016

(54) LIQUID JET HEAD AND LIQUID JET APPARATUS

(71) Applicant: SII PRINTEK INC., Chiba-shi, Chiba (JP)

(72) Inventors: Daichi Nishikawa, Chiba (JP); Yuzuru Kubota, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/534,826

(22) Filed: Nov. 6, 2014

(65) Prior Publication Data

US 2015/0158299 A1 Jun. 11, 2015

(30) Foreign Application Priority Data

Dec. 5, 2013 (JP) ..... 2013-252411

(51) Int. Cl.
*B41J 2/14* (2006.01)

(52) U.S. Cl.
CPC .... *B41J 2/14209* (2013.01); *B41J 2002/14491* (2013.01); *B41J 2202/18* (2013.01)

(58) Field of Classification Search
CPC ..... B41J 2/14209; B41J 2002/14491; B41J 2202/18
USPC ..... 347/50, 68, 69
See application file for complete search history.

(56) References Cited

U.S. PATENT DOCUMENTS

2007/0285470 A1 12/2007 Kanaya ..... 347/63
2009/0315957 A1* 12/2009 Koseki ..... 347/68

FOREIGN PATENT DOCUMENTS

| | | |
|---|---|---|
| JP | 2011093105 | 5/2011 |
| JP | 2011245833 | 12/2011 |
| JP | 2012011704 | 1/2012 |
| WO | 2012002131 | 1/2012 |
| WO | 2012176874 | 12/2012 |

OTHER PUBLICATIONS

IPO Search Report mailed Jun. 4, 2015 issued in Appln. No. GB1421486.0.

* cited by examiner

*Primary Examiner* — Henok Legesse
(74) *Attorney, Agent, or Firm* — Adams & Wilks

(57) ABSTRACT

A liquid jet head includes a head chip and a circuit board connected to the head chip. The head chip includes common terminals arranged in a reference direction. The circuit board includes shared terminals, an upper common wiring, and a through electrode. The shared terminals are provided on a lower surface of the circuit board on the head chip side and are electrically connected to the common terminals. The upper common wiring extends in the reference direction and is provided on a top surface of the circuit board opposite to the head chip. The through electrode electrically connects each of the shared terminals to the upper common wiring.

14 Claims, 8 Drawing Sheets

LIQUID JET HEAD AND LIQUID JET APPARATUS

BACKGROUND OF THE INVENTION

1. Technical Field

The present invention relates to a liquid jet head and liquid jet apparatus that are configured to jet droplets onto a recording medium to record information.

2. Related Art

In an ink-jet-method currently in use, a liquid jet head is configured to jet ink droplets, for example, onto recording paper to record a character or a figure, or to eject a liquid material to form a functional thin film on the surface of an element substrate. In the method, liquid such as ink or a liquid material is led to a channel from a liquid tank through a supply pipe, and a pressure is applied to the liquid filled in the channel such that the liquid is ejected as droplets from a nozzle communicating with the channel. When the droplets are ejected, the liquid jet head and the recording medium are moved to record a character or a figure or to form a functional thin film or three-dimensional structure having a predetermined shape.

The liquid jet head as described above is described in JP 2011-245833 A. FIG. 8 (FIG. 8 in JP 2011-245833 A) is a schematic top view of a liquid jet head 101 from which the cover plate is removed. An actuator substrate 102 includes ejection grooves C and non-ejection grooves D that are alternately arranged on the top surface, drive electrodes 109 that are installed on the side surfaces of the ejection grooves C and non-ejection grooves D, first terminal electrodes 110a that are electrically connected to the drive electrodes 109 of the ejection grooves C, and second terminal electrodes 110b that each are electrically connected to the drive electrode 109 installed on the side surface on the ejection groove C side of the two non-ejection grooves D holding an ejection groove C therebetween. Each of the ejection grooves C is formed from a front end FE to a position short of a rear end RE, and each of the non-ejection grooves D is formed from the front end FE to the rear end RE. A nozzle plate 105 is installed on the front end FE of the actuator substrate 102. A flexible substrate 103 is installed on a substrate surface 115 near the rear end RE of the actuator substrate 102.

A common wiring electrode 111a and a plurality of individual wiring electrodes 111b are formed on the surface on the actuator substrate 102 side of the flexible substrate 103. The common wiring electrode 111a is electrically connected to each of the first terminal electrodes 110a at each of the first connection points 116a. Each of the individual wiring electrodes 111b is electrically connected to each of the second terminal electrodes 110b at each of the second connection points 116b. Note that a cover plate (not illustrated in the drawing) is bonded to the substrate surface 115 of the actuator substrate 102. The cover plate covers a part of an upper opening in each of the ejection grooves C so as to form a channel that is to be filled with liquid. The cover plate includes a liquid chamber to be capable of supplying the liquid to each of the ejection grooves C. Nozzles 114 communicating with the ejection grooves C are formed on the nozzle plate 105. Note that an insulating layer 117 is installed between the common wiring electrode 111a and each of the non-ejection grooves D so as to prevent an electric short-circuit between the common wiring electrode 111a and each of the drive electrodes 109 installed on the side surfaces of the non-ejection grooves D.

The liquid jet head 101 is driven as described below. Liquid is filled in each of the ejection grooves C from the liquid chamber of the cover plate (not illustrated in the drawing). The common wiring electrode 111a is installed on a GND to supply a drive signal to the individual wiring electrodes 111b. This thickness-shear deforms a partition 107 among an ejection groove C and two non-ejection grooves D that hold the ejection groove C therebetween. This causes to eject the droplets from the nozzles 114 communicating with the ejection grooves C. Accordingly, supplying a drive signal to an arbitrary individual wiring electrodes 111b can simultaneously eject the droplets from the corresponding nozzles 114.

JP 2011-93105 A describes a liquid jet head on which a plurality of pressure chambers configured to eject droplets by applying a pressure to liquids, piezoelectric body layers bonded to the pressure chambers through vibrating plates, and a common wiring and individual wirings configured to apply a drive signal to the piezoelectric body layer are installed. The common wiring is commonly connected to the piezoelectric body layers whereas the individual wirings are individually connected to the piezoelectric body layers. Supplying a drive signal between the common wiring and the individual wiring deforms the piezoelectric body layer. The deformation momentarily changes the volume of the pressure chamber by deforming the vibrating plate. This causes to eject the droplets from the nozzle communicating with the pressure chamber.

JP 2011-93105 A describes that there is a problem in that heat is generated at the joint portion between the pad portion of the common wiring and the terminal portion of a film-shaped wiring board bonded to the pad portion because the increase in the number of the piezoelectric body layers driving the liquid jet head increases the current flowing through the common wiring.

The liquid jet head 101 in JP 2011-245833 A ejects the droplets simultaneously from the nozzles 114 communicating with the corresponding ejection grooves C by supplying the drive signal simultaneously to the individual wiring electrodes 111b. However, similarly to JP 2011-93105 A, the common wiring electrode 111a is electrically connected to all of the first terminal electrodes 110a. Thus, driving many ejection grooves C simultaneously causes overcurrent. This sometimes causes the common wiring electrode 111a to generate heat. When the common wiring electrode 111a is extended in width to avoid the overcurrent, the first terminal electrode 110a needs to be extended in the direction of the groove of the ejection groove C. This increases the size of the actuator substrate 102.

SUMMARY OF THE INVENTION

The liquid jet head of the present invention includes: a head chip including a plurality of common terminals arranged in a reference direction; and a circuit board connected to the head chip. The circuit board includes: a plurality of shared terminals installed on a lower surface on the head chip side and electrically connected to the common terminals, respectively; a upper common wiring installed on a top surface opposite to the head chip side and extending in the reference direction; and a through electrode electrically connecting each of the shared terminals to the upper common wiring.

The head chip includes a plurality of active terminals arranged parallel to the common terminals and in the reference direction. The circuit board includes a plurality of individual terminals installed on the lower surface and arranged parallel to the shared terminals and in the reference direction. The active terminals are electrically connected to the individual terminals, respectively.

The upper common wiring covers upper portions of the active terminals.

The circuit board includes a lower common wiring extending on the lower surface in the reference direction and electrically connected to the shared terminals.

The electrode width of the upper common wiring in a direction perpendicular to the reference direction is larger than the electrode width of the lower common wiring in a direction perpendicular to the reference direction.

The cross-sectional area of the upper common wiring in a direction perpendicular to the reference direction is larger than the cross-sectional area of the lower common wiring in a direction perpendicular to the reference direction.

The density of installation of the through electrodes in the reference direction near both ends of a sequence of the common terminals is higher than near a center of the sequence.

The density of installation of the through electrodes in the reference direction is approximately constant.

Each of the through electrodes is installed at an intersection at which the shared terminal intersects the lower common wiring.

The head chip includes a concavity between the common terminals and the active terminals. The lower common wiring faces an upper end opening of the concavity.

In a planar view in a vertical direction of a substrate surface of the circuit board, the shared terminals protrude from the upper common wiring.

On the head chip, ejection grooves and non-ejection grooves are alternately arranged in the reference direction. The common terminals are electrically connected to drive electrodes installed on side surfaces of the ejection grooves. Each of the active terminals is electrically connected to a drive electrode installed on a side surface on an ejection groove side of two non-ejection grooves holding the ejection groove therebetween.

The liquid jet apparatus of the present invention includes: the liquid jet head; a moving mechanism configured to move the liquid jet head and a recording medium relatively; a liquid supply pipe configured to supply liquid to the liquid jet head; and a liquid tank configured to supply the liquid to the liquid supply pipe.

The liquid jet head according to the present invention includes: a head chip including a plurality of common terminals arranged in a reference direction; and a circuit board connected to the head chip. The circuit board includes: a plurality of shared terminals installed on a lower surface on the head chip side and electrically connected to the common terminals, respectively; an upper common wiring installed on a top surface opposite to the head chip side and extending in the reference direction; and a through electrode electrically connecting each of the shared terminal to the upper common wiring. This can further reduce the wiring resistance in comparison to when a common wiring is installed only on the lower surface of the circuit board.

DETAILED DESCRIPTION OF THE INVENTION (First Embodiment)

Figure 1A:
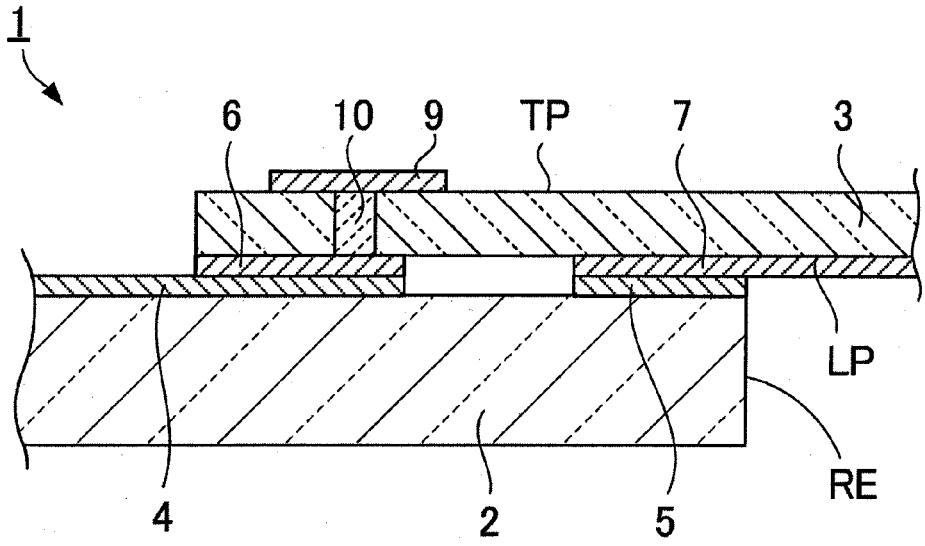
FIGS. 1A and 1B are explanatory views of a liquid jet head according to a first embodiment in the present invention.
Figure 1B:
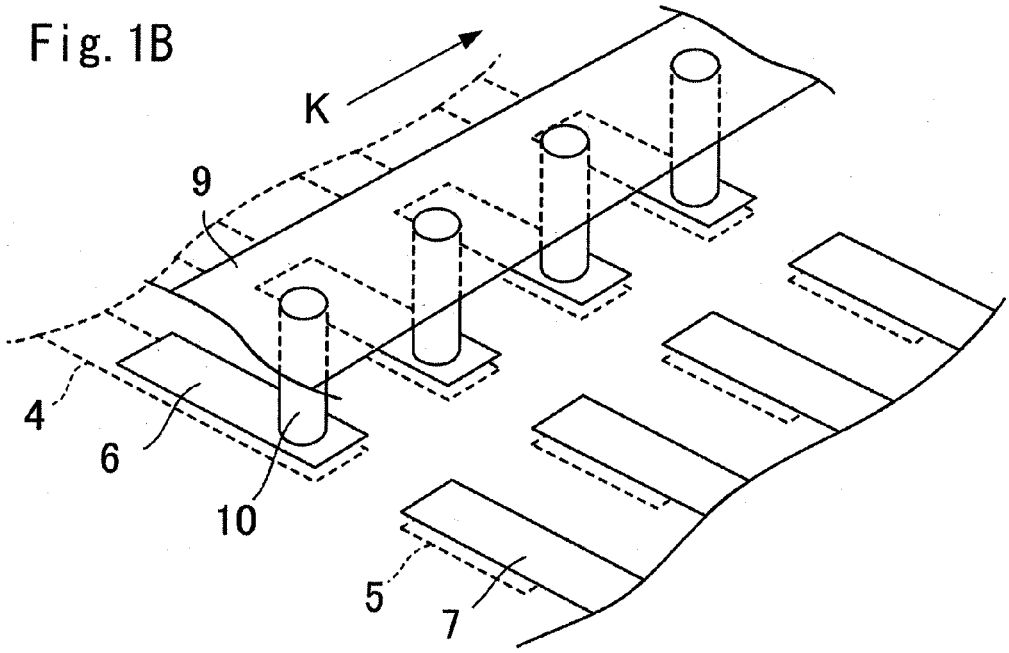
Figure 2A:
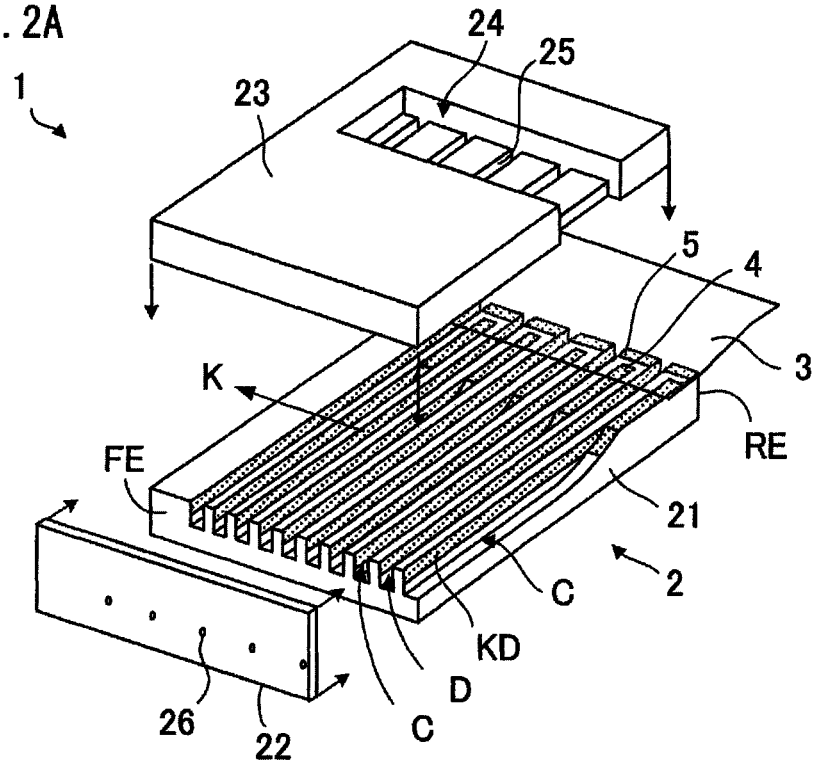
FIGS. 2A and 2B are explanatory views of the liquid jet head according to the first embodiment in the present invention.
Figure 2B:
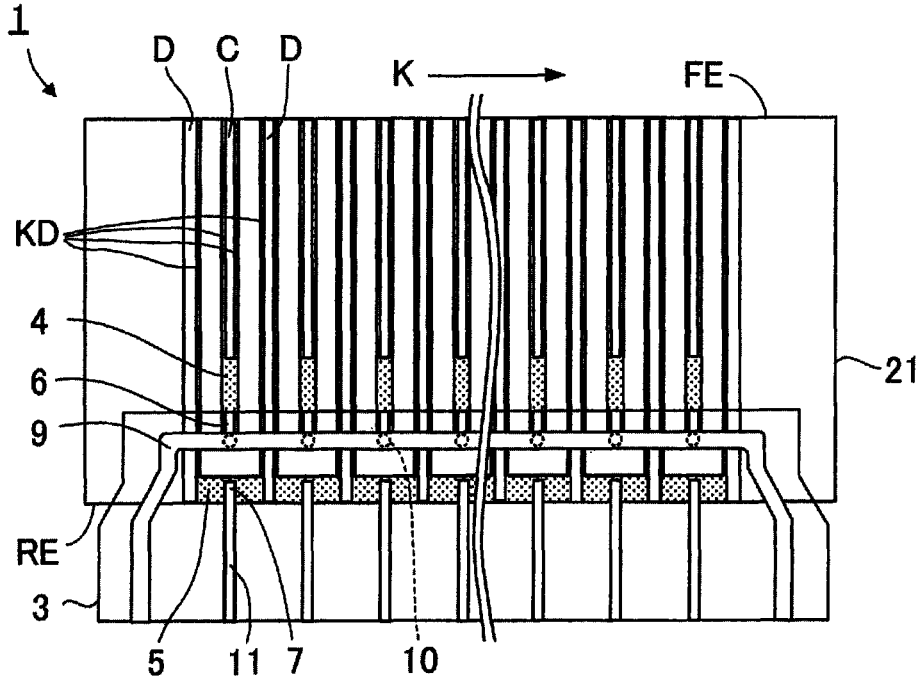

FIGS. 1A and 1B, and FIGS. 2A and 2B are explanatory views of a liquid jet head 1 according to the first embodiment of the present invention. FIG. 1A is a schematic partial cross-sectional view of the liquid jet head 1. FIG. 1B is a schematic view of the configuration of the electrodes on a circuit board 3. FIG. 2A is an exploded perspective view of the liquid jet head 1. FIG. 2B is a schematic top view of the liquid jet head 1 from which a cover plate 23 and a nozzle plate 22 are removed.

As illustrated in FIGS. 1A and 1B, the liquid jet head 1 includes a head chip 2 and the circuit board 3 connected to the head chip 2. The head chip 2 includes a plurality of common terminals 4 arranged on the surface in a reference direction K (the direction toward the back of the drawing sheet of FIG. 1A). The circuit board 3 includes a plurality of shared terminals 6 installed on the lower surface LP on the head chip 2 side and electrically connected to the common terminals 4 respectively, an upper common wiring 9 installed on a top surface TP opposite to the head chip 2 side and extending in the reference direction K, and through electrodes 10 electrically connecting the shared terminals 6 to the upper common wiring 9. As described above, installing the upper common wiring 9 on the top surface TP of the circuit board 3 can form the wiring having a wider width in a direction perpendicular to the reference direction K than when the common wiring is installed only on the lower surface of the circuit board 3. This can reduce the wiring resistance.

The head chip 2 further includes active terminals 5 electrically separating from the common terminals 4 on the surface between the common terminals 4 and the rear end RE. The active terminals 5 are formed correspondingly to the common terminals 4 and are arranged parallel to the common terminals 4 in the reference direction K (see FIG. 1B and FIGS. 2A and 2B). The circuit board 3 includes a plurality of individual terminals 7 on the lower surface LP. The individual terminals 7 are arranged parallel to the shared terminals 6 in the reference direction K, and are electrically connected to the active terminals 5, respectively.

In that case, the active terminals 5 are installed nearer to the rear end RE side than the common terminals 4. Thus, when the common wiring commonly connecting the shared terminals 6 is installed on the lower surface LP side, the electrode width is limited. In the present embodiment, installing the upper common wiring 9 on the top surface TP of the circuit board 3 can form the electrode having a wide width regardless of the active terminals 5 or the individual terminals 7.

The liquid jet head 1 will concretely be described using FIG. 2A. The liquid jet head 1 includes the head chip 2 and the circuit board 3. The head chip 2 includes a piezoelectric body substrate 21, the cover plate 23 installed on the surface of the piezoelectric body substrate 21, and a nozzle plate 22 bonded to a front end FE of the piezoelectric body substrate 21. The ejection grooves C and the non-ejection grooves D are alternately arranged in the reference direction K on a surface of the piezoelectric body substrate 21. The common terminals 4 are installed on the surface on the rear end RE side. The active terminals 5 are installed between the common terminals 4 and the rear end RE. A liquid chamber 24 is formed on the cover plate 23. The liquid chamber 24 communicates with the ejection grooves C through slits 25. The nozzles 26 are formed on the nozzle plate 22. The nozzles 26 communicate with the ejection grooves C. The circuit board 3 is connected to the surface of the piezoelectric body substrate 21 near the rear end RE.

As illustrated in FIG. 2B, the ejection grooves C are formed from the front end FE of the piezoelectric body substrate 21 to positions short of the rear end RE, and the non-ejection grooves D are formed from the front end FE to the rear end RE. Drive electrodes KD are installed on the side surfaces of the ejection grooves C and non-ejection grooves D. Each of the drive electrodes KD is formed from the upper end of each of the grooves to approximately ½ of the depth of the groove. The common terminals 4 are electrically connected to the drive electrodes KD installed on both sides of the ejection groove C. The active terminals 5 are electrically connected to the two drive electrodes KD installed on the side surfaces on the ejection groove C side of the two non-ejection grooves D holding the ejection groove C therebetween. The active terminals 5 are installed between the common terminals 4 and the rear end RE. The shared terminals 6 and the individual terminals 7 are installed on the lower surface LP on the piezoelectric body substrate 21 side of the circuit board 3. Each of the shared terminals 6 are installed at a position corresponding to each of the common terminals 4 and is electrically connected to each of the common terminals 4 through an anisotropic conductive material (not illustrated in the drawings). Similarly, each of the individual terminals 7 is installed at a position corresponding to each of the active terminals 5 and is electrically connected to each of the active terminals 5 through an anisotropic conductive material (not illustrated in the drawings). Each of the individual terminals 7 is further electrically connected to each of the individual wirings 11 correspondingly installed on the lower surface LP. The upper common wiring 9 extends in the reference direction K on the top surface TP of the circuit board 3. The upper common wiring 9 is electrically connected to each of the shared terminals 6 through the through electrode 10, and further extends from both end sides of the common terminals 4 arranged in the reference direction K to the outsides of the individual wiring 11 similarly arranged in the reference direction K.

In that case, a glass substrate, a glass epoxy substrate, or a flexible circuit board using a plastic material such as polyimide can be used as the circuit board 3. For example, layering a Cu film, an Ni film, and an Au film with a plating method can form the shared terminals 6, the individual terminals 7 and the upper common wiring 9. Forming a through hole in, the circuit board 3 and filling a conductive material such as Cu, Ni, Au, or Ag into the through hole with a plating method can form the through electrode 10. The head chip 2 is formed, for example, of a piezoelectric body substrate which is made of PZT ceramics or the like. A metal material such as Al, Ti, Ni, Au, and Ag can be used as the common terminals 4 and the active terminals 5. Placing an anisotropic conductive material between the common terminals 4 and the shared terminals 6, and between the active terminals 5 and the individual terminals 7 and thermal-compression bonding them can electrically connect the terminals to each other.

It is noted that the liquid jet head 1 of the present invention is not limited to one of an edge shoot type as described in the present embodiment, and can be of a side shoot type in which the nozzle plate 22 is installed on a surface of the piezoelectric body substrate 21 opposite to the cover plate 23. The shared terminals 6 and the individual terminals 7 can be installed on the surface of the piezoelectric body substrate 21 opposite to the cover plate 23. The piezoelectric body element can be of a flexural mode type or a longitudinal mode type other than of the shearing type as described in the present embodiment.

(Second Embodiment)

Figure 3A:
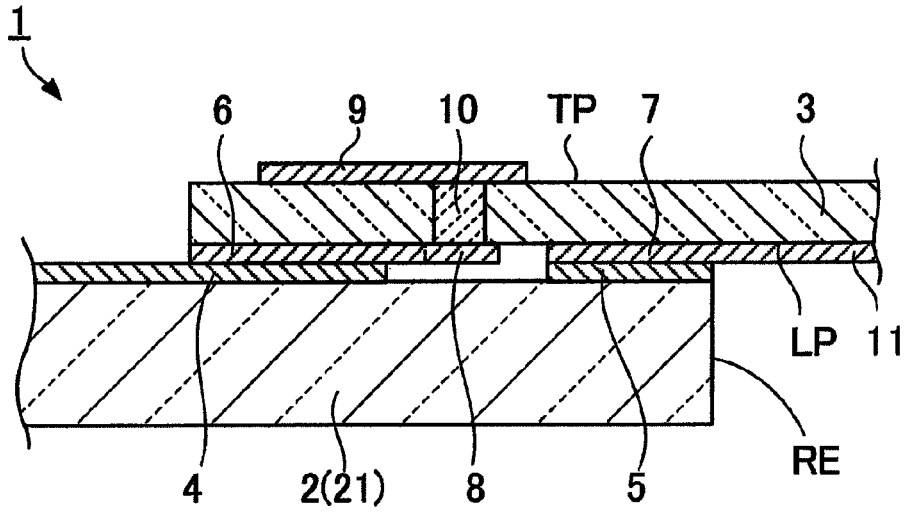
FIGS. 3A and 3B are explanatory views of a liquid jet head according to a second embodiment in the present invention.
Figure 3B:
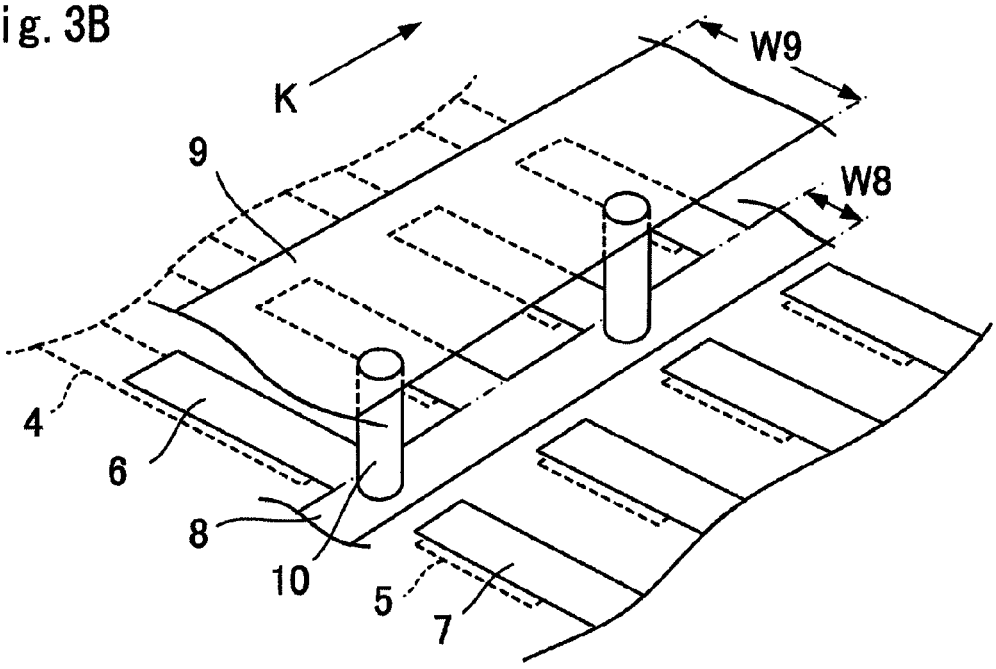

FIGS. 3A and 3B are explanatory views of a liquid jet head 1 according to the second embodiment of the present invention. FIG. 3A is a schematic partial cross-sectional view of the liquid jet head 1. FIG. 3B is a schematic view of the configuration of the electrodes in a circuit board 3. The same parts or the parts having the same functions as in the first embodiment are denoted with the same reference signs.

As illustrated in FIG. 3A, the liquid jet head 1 includes a head chip 2 and the circuit board 3. The head chip 2 includes a plurality of common terminals 4 arranged in a reference direction K (the direction toward the back of the drawing sheet of FIG. 3A), and a plurality of active terminals 5 arranged on the surface nearer to the rear end RE than the common terminals 4 in the reference direction K. The circuit board 3 includes a plurality of shared terminals 6 installed on the lower surface LP on the head chip 2 side and electrically connected to the common terminals 4 respectively, and a lower common wiring 8 extending in the lower surface LP on the head chip 2 side in the reference direction K and electrically connected to the shared terminals 6. The circuit board 3 includes a upper common wiring 9 installed on the top surface TP opposite to the head chip 2 and extending in the reference direction K, and through electrodes 10 electrically connecting the lower common wiring 8 and the upper common wiring 9. Accordingly, the upper common wiring 9 is electrically connected to the shared terminals 6 through the through electrodes 10 and the lower common wiring 8. Note that a plurality of individual terminals 7 is electrically connected to the individual wirings 11, respectively.

As further illustrated in FIG. 3B, an electrode width W9 of the upper common wiring 9 in a direction perpendicular to the reference direction K is larger than an electrode width W8 of the lower common wiring 8 in a direction perpendicular to the reference direction K. Furthermore, the cross-sectional area of the upper common wiring 9 in the direction perpendicular to the reference direction K (the electrode width W9×the thickness of the upper common wiring 9) is larger than the cross-sectional area of the lower common wiring 8 in the direction perpendicular to the reference direction K (the electrode width W8×the thickness of the lower common wiring 8). The lower common wiring 8 is electrically connected to the upper common wiring 9 through the through electrodes 10. As described above, installing the lower common wiring 8 in addition to the upper common wiring 9 further reduces the wiring resistance of the common wirings and softens the local concentration of the current. This suppresses the heat generation.

In that case, a glass substrate, a glass epoxy substrate, or a flexible circuit board using a plastic material such as polyimide can be used as the circuit board 3. For example, layering a Cu film, an Ni film, and an Au film with a plating method can form the shared terminals 6, the individual terminals 7 and the upper common wiring 9. Forming a through hole in the circuit board 3 and filling a conductive material such as Cu, Ni, Au, or Ag into the through hole with a plating method can form the through electrode 10. The head chip 2 is formed, for example, of a piezoelectric body substrate which is made of PZT ceramics or the like. A metal material such as Al, Ti, Ni, Au, and Ag can be used as the common terminals 4 and the active terminals 5. Placing an anisotropic conductive material between the common terminals 4 and the shared terminals 6, and between the active terminals 5 and the individual terminals 7 and thermal-compression bonding them can electrically connect the terminals to each other.

It is not necessary to form the through electrodes 10 as many as the shared terminals 6. Reducing the number of the through electrodes 10 to less than the number of the shared terminals 6 reduces the manufacturing cost. Furthermore, similarly to the first embodiment, the electrode of the upper common wiring 9 can be formed so as to have a wide width regardless of the active terminals 5 or the individual terminals 7. This can reduce the wiring resistance.

As illustrated in FIG. 3B, each of the through electrodes 10 is installed at the intersection at which each of the shared terminals 6 intersects the lower common wiring 8. This expands the junction areas of the through electrodes 10, and the lower common wiring 8 and shared terminals 6 and increases the through electrode 10 in diameter. This can reduce the wiring resistance.

(Third Embodiment)

Figure 4A:
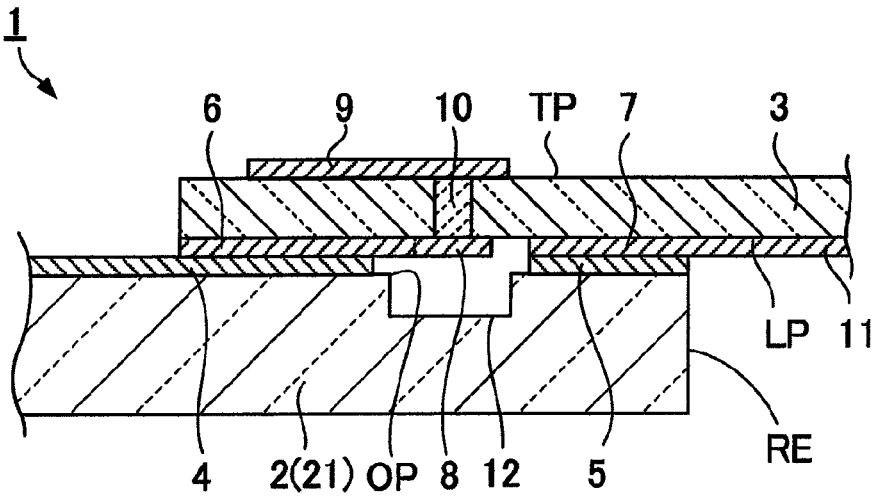
FIGS. 4A and 4B are explanatory views of a liquid jet head according to a third embodiment in the present invention.
Figure 4B:
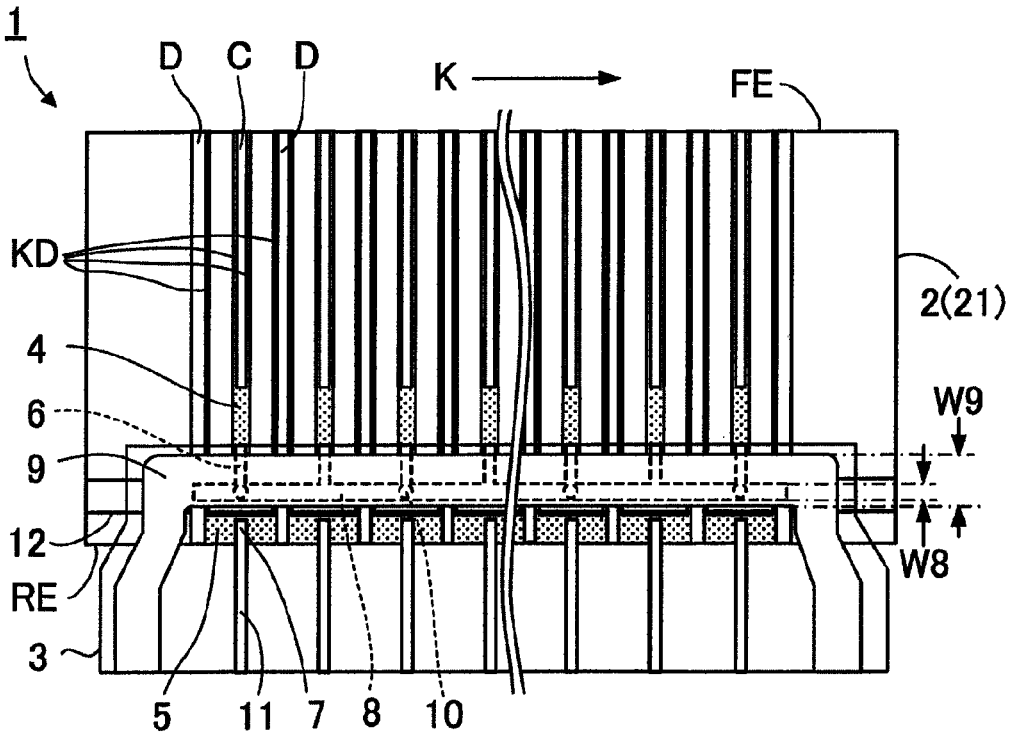

FIGS. 4A and 4B are explanatory views of a liquid jet head 1 according to the third embodiment of the present invention. FIG. 4A is a schematic partial cross-sectional view of the liquid jet head 1. FIG. 4B is a schematic plan view of the liquid jet head 1 from which a nozzle plate 22 and a cover plate 23 are removed. The same parts or the parts having the same functions as in the first or second embodiment are denoted with the same reference signs.

As illustrated in FIG. 4A, the liquid jet head 1 includes a head chip 2 and a circuit board 3. The head chip 2 includes a plurality of common terminals 4 arranged in a reference direction K (the direction toward the back of the drawing sheet of FIG. 4A), and a plurality of active terminals 5 arranged on the surface nearer to the rear end RE than the common terminals 4 in the reference direction K. A concavity 12 is formed in the reference direction K on a surface of the head chip 2 (concretely, a piezoelectric body substrate 21) and between the common terminals 4 and the active terminals 5. The circuit board 3 includes a plurality of shared terminals 6 installed on the lower surface LP on the head chip 2 side and electrically connected to the common terminals 4 respectively, and a lower common wiring 8 extending on the lower surface LP on the head chip 2 side in the reference direction K and electrically connected to the shared terminals 6. The lower common wiring 8 faces an upper end opening OP of the concavity 12. Concretely, in a direction perpendicular to the reference direction K, the electrode width W8 of the lower common wiring 8 is smaller than the width of the upper end opening OP of the concavity 12, and is positioned in the upper region of the upper end opening OP. This separates the lower common wiring 8 from the piezoelectric body substrate 21 and thus prevents an electric short-circuit between the lower common wiring 8 and drive electrodes KD installed on the side surfaces of the non-ejection grooves D. The circuit board 3 further includes an upper common wiring 9 installed on the top surface TP opposite to the head chip 2 and extending in the reference direction K, and through electrodes 10 electrically connecting the lower common wiring 8 and the upper common wiring 9. Accordingly, the upper common wiring 9 is electrically connected to the shared terminals 6 through the through electrodes 10 and the lower common wiring 8.

As further illustrated in FIG. 4B, an electrode width W9 of the upper common wiring 9 in a direction perpendicular to the reference direction K is larger than the electrode width W8 of the lower common wiring 8 in a direction perpendicular to the reference direction K. Furthermore, the cross-sectional area of the upper common wiring 9 in the direction perpendicular to the reference direction K (the electrode width W9×the thickness of the upper common wiring 9) is larger than the cross-sectional area of the lower common wiring 8 in the direction perpendicular to the reference direction K (the electrode width W8×the thickness of the lower common wiring 8). The lower common wiring 8 is electrically connected to the upper common wiring 9 through the through electrodes 10. As a result, similarly to the first and second embodiments, the electrode of the upper common wiring 9 can be formed so as to have a wide width regardless of the active terminals 5 and the individual terminals 7. This further reduces the wiring resistance and softens the local concentration of the current. This suppresses the heat generation.

In that case, a glass substrate, a glass epoxy substrate, or a flexible circuit board using a plastic material such as polyimide can be used as the circuit board 3. For example, layering a Cu film, an Ni film, and an Au film with a plating method can form the shared terminals 6, the individual terminals 7 and the upper common wiring 9. Forming a through hole in the circuit board 3 and filling a conductive material such as Cu, Ni, Au, or Ag into the through hole with a plating method can form the through electrode 10. The head chip 2 is formed, for example, of a piezoelectric body substrate which is made of PZT ceramics or the like. A metal material such as Al, Ti, Ni, Au, and Ag can be used as the common terminals 4 and the active terminals 5. Placing an anisotropic conductive material between the common terminals 4 and the shared terminals 6, and between the active terminals 5 and the individual terminals 7 and thermal-compression bonding them can electrically connect the terminals to each other.

Note that it is not necessary to form the through electrodes 10 as many as the shared terminals 6. Reducing the number of the through electrodes 10 to less than the number of the shared terminals 6 reduces the manufacturing cost. There is not a short-circuit between the lower common wiring 8 and the exposed electrode even when another electrode or the like is exposed to the surface of the head chip 2 because the lower common wiring 8 corresponds to the upper end opening OP of the concavity 12 as described above. As illustrated in FIG. 4B, each of the through electrodes 10 is installed at the intersection at which each of the shared terminals 6 intersects the lower common wiring 8. This expands the junction areas of the through electrodes 10 and the lower common wiring 8, and increases the through electrode 10 in diameter. This can reduce the wiring resistance.

In the third embodiment, the concavity 12 is formed on the head chip 2 and the lower common wiring 8 corresponds to the upper end opening OP of the concavity 12. However, alternatively, the concavity can be formed on the surface on the head chip 2 side of the circuit board 3 such that the lower common wiring 8 can be installed on the bottom surface of the concavity. This separates the lower common wiring 8 from the piezoelectric body substrate 21, and thus prevents an electric short-circuit between the lower common wiring 8 and the drive electrodes KD installed on the side surfaces of the non-ejection grooves D.

(Fourth Embodiment)

Figure 5A:
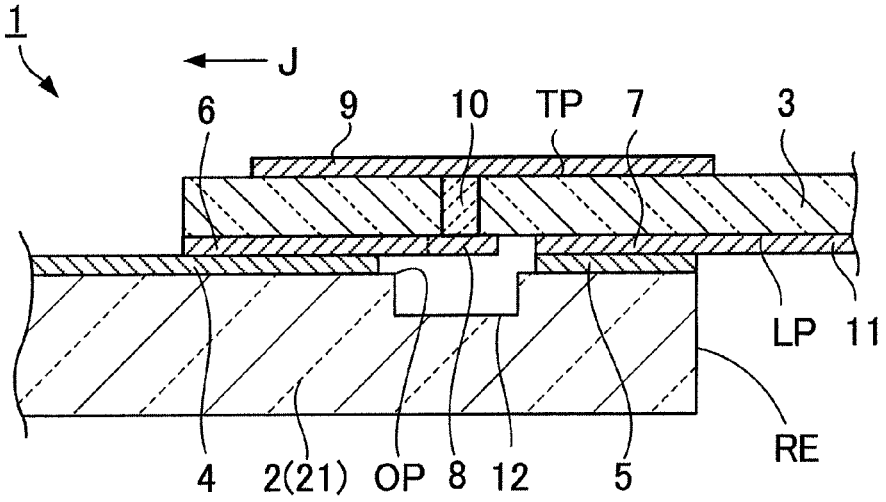
FIGS. 5A and 5B are explanatory views of a liquid jet head according to a fourth embodiment in the present invention.
Figure 5B:
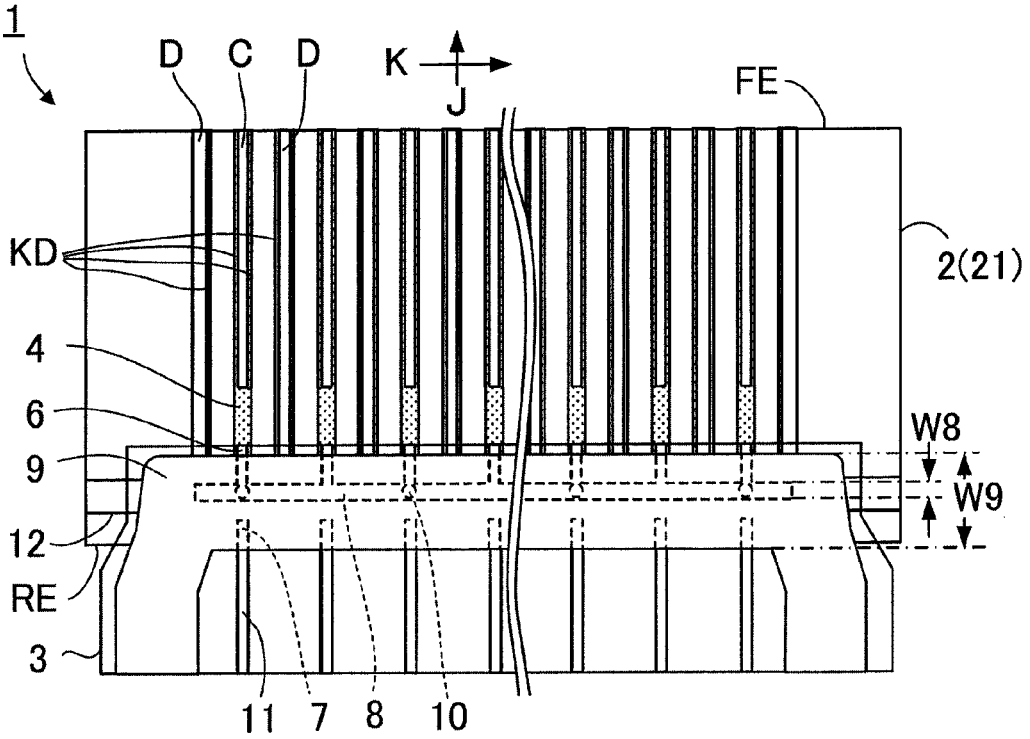

FIGS. 5A and 5B are explanatory views of a liquid jet head 1 according to the fourth embodiment of the present invention. FIG. 5A is a schematic cross-sectional view of the liquid jet head 1. FIG. 5B is a schematic top view of the liquid jet head 1 from which a nozzle plate 22 and a cover plate 23 are removed. The descriptions of the same parts as in the first to third embodiments will be omitted. The same parts or the parts having the same functions as in the first to third embodiments are denoted with the same reference signs.

As illustrated in FIGS. 5A and 5B, the liquid jet head 1 includes a head chip 2 and a circuit board 3. The head chip 2 includes a plurality of common terminals 4 arranged in a reference direction K (the direction toward the back of the drawing sheet of FIG. 5A), and a plurality of active terminals 5 arranged on the surface nearer to the rear end RE than the common terminals 4 in the reference direction K. The head chip 2 includes a concavity 12 between the common terminals 4 and the active terminals 5. The circuit board 3 includes a plurality of shared terminals 6 installed on the lower surface LP on the head chip 2 side and electrically connected to the common terminals 4 respectively, and a lower common wiring 8 extending in the reference direction K and electrically connected to the shared terminals 6. The lower common wiring 8 faces an upper end opening OP of the concavity 12. Concretely, in a direction perpendicular to the reference direction K, the electrode width W8 of the lower common wiring 8 is smaller than the width of the upper end opening OP of the concavity 12, and is positioned in the upper region of the upper end opening OP. This separates the lower common wiring 8 from a piezoelectric body substrate 21 and thus prevents an electric short-circuit between the lower common wiring 8 and drive electrodes KD installed on the side surfaces of non-ejection grooves D. The circuit board 3 further includes an upper common wiring 9 installed on the top surface TP opposite to the head chip 2 and extending in the reference direction K, and through electrodes 10 electrically connecting the lower common wiring 8 and the upper common wiring 9. Accordingly, the upper common wiring 9 is electrically connected to the shared terminals 6 through the through electrodes 10 and the lower common wiring 8. Note that a plurality of individual terminals 7 is electrically connected to a plurality of individual wirings 11.

In a planar view in the vertical direction of the substrate side of the circuit board 3, the shared terminals 6 protrude from the upper common wiring 9. More specifically, the shared terminals 6 protrude from the upper common wiring 9 in a direction J perpendicular to the reference direction K in the planar view. Accordingly, when the circuit board 3 is made of a translucent material, for example, a translucent plastic material such as a polyimide film, the positions of the shared terminals 6 can be visible from above. This facilitates the alignment of the shared terminals 6 on the circuit board 3 with the common terminals 4 on the head chip 2. The lower common wiring 8 faces the upper end opening OP of the concavity 12. Concretely, in the direction J perpendicular to the reference direction K, the electrode width W8 of the lower common wiring 8 is smaller than the width of the upper end opening OP of the concavity 12, and is positioned in the upper region of the upper end opening OP. Thus, even when another electrode is exposed to the surface of the piezoelectric body substrate 21, an electric short-circuit between the exposed electrode and the lower common wiring 8 can be prevented.

The circuit board 3 further includes the plurality of individual terminals 7 arranged in the reference direction K and parallel to the shared terminals 6 on the lower surface LP. The active terminals 5 are electrically connected to the individual terminals 7, respectively. The individual terminals 7 are electrically connected to the individual wirings 11, respectively. The upper common wiring 9 covers the upper portions of the active terminals 5. As described above, when the upper common wiring 9 is installed while having a wide width so as to reach the end portion on the rear end RE side of the active terminals 5 or protrude toward the rear side over the end portion on the rear end RE side, the positions of the active terminals 5 are not visible in the planar view in the vertical direction of the circuit board 3. Even in that case, the positions of the shared terminals 6 on the circuit board 3 and the positions of the common terminals 4 on the head chip 2 can simultaneously be visible. This can facilitate the alignment of the circuit board 3 with the head chip 2.

The above will be described more concretely. As illustrated in FIG. 5B, the ejection grooves C and the non-ejection grooves D are alternately arranged in the reference direction K on a surface of the piezoelectric body substrate 21 included in the head chip 2. The ejection grooves C are formed from the front end FE of the piezoelectric body substrate 21 to positions short of the rear end RE, and the non-ejection grooves D are formed from the front end FE of the piezoelectric body substrate 21 to the rear end RE. The common terminals 4 are electrically connected to the drive electrodes KD installed on the side surfaces of the ejection grooves C. Each of the active terminals 5 is electrically connected to the drive electrode KD installed on the side surface on the ejection groove C side of the two non-ejection grooves D holding the ejection groove C therebetween. The active terminals 5 are installed on the surface of the piezoelectric body substrate 21 near the rear end RE. The concavity 12 is formed on the front end FE side of the active terminals 5. The common terminals 4 are installed on the front end FE side of the concavity 12. The common terminals 4 and the active terminals 5 correspond to each other in a direction of groove while holding the concavity 12 therebetween, and are arranged in the reference direction K at same pitches. The shared terminals 6 and individual terminals 7 installed on the circuit board 3 are placed so as to correspond to the common terminals 4 and the active terminals 5. Accordingly, aligning the shared terminals 6 on the circuit board 3 with the common terminals 4 on the head chip 2 can simultaneously align the individual terminals 7 with the active terminals 5.

Each of the drive electrodes KD of the non-ejection grooves D is formed to the corner between the side surface of the non-ejection groove D and the surface of the piezoelectric body substrate 21 while the side surface intersecting the lower common wiring 8 is recessed downward because of the concavity 12. Thus, there is not an electric short-circuit between the lower common wiring 8 and the drive electrodes KD of the non-ejection groove D. In the present embodiment, similarly to the second and third embodiments, the electrode of the upper common wiring 9 can be formed so as to have a wide width regardless of the active terminals 5 and the individual terminals 7. This further reduces the wiring resistance and softens the local concentration of the current. This suppresses the heat generation. Instead of forming the concavity 12 on the head chip 2, the concavity can be formed on the surface on the head chip 2 side of the circuit board 3 such that the lower common wiring 8 can be installed on the bottom surface of the concavity. This separates the lower common wiring 8 from the piezoelectric body substrate 21. Thus, there is not an electric short-circuit between the lower common wiring 8 and the drive electrodes KD installed on the side surfaces of the non-ejection grooves D.

In that case, a glass substrate, a glass epoxy substrate, or a flexible circuit board using a plastic material such as polyimide can be used as the circuit board 3. For example, layering a Cu film, an Ni film, and an Au film with a plating method can form the shared terminals 6, the individual terminals 7 and the upper common wiring 9. Forming a through hole in the circuit board 3 and filling a conductive material such as Cu, Ni, Au, or Ag into the through hole with a plating method can form the through electrode 10. The head chip 2 is formed, for example, of a piezoelectric body substrate which is made of PZT ceramics or the like. A metal material such as Al, Ti, Ni, Au, and Ag can be used as the common terminals 4 and the active terminals 5. Placing an anisotropic conductive material between the common terminals 4 and the shared terminals 6, and between the active terminals 5 and the individual terminals 7 and thermal-compression bonding them can electrically connect the terminals to each other.

Figure 6A:
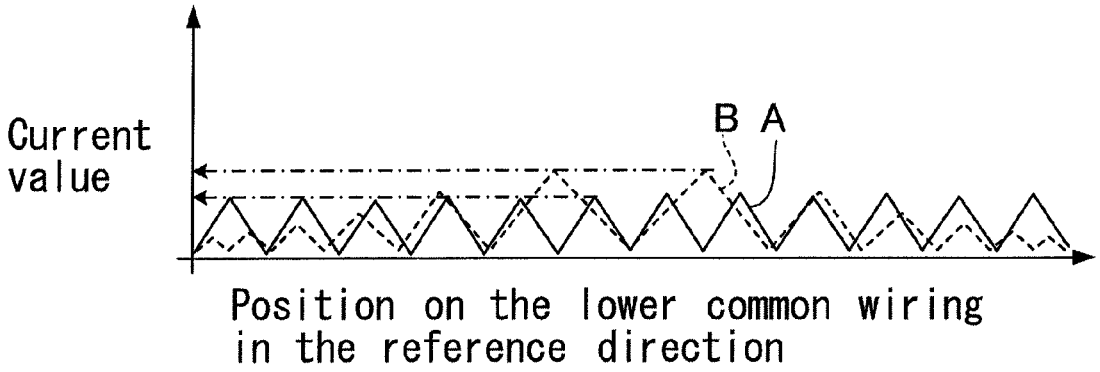
FIGS. 6A and 6B are views of the current value flowing in a lower common wiring at a position on the low common wiring in a reference direction in the liquid jet head according to the second to fourth embodiments of the present invention.
Figure 6B:
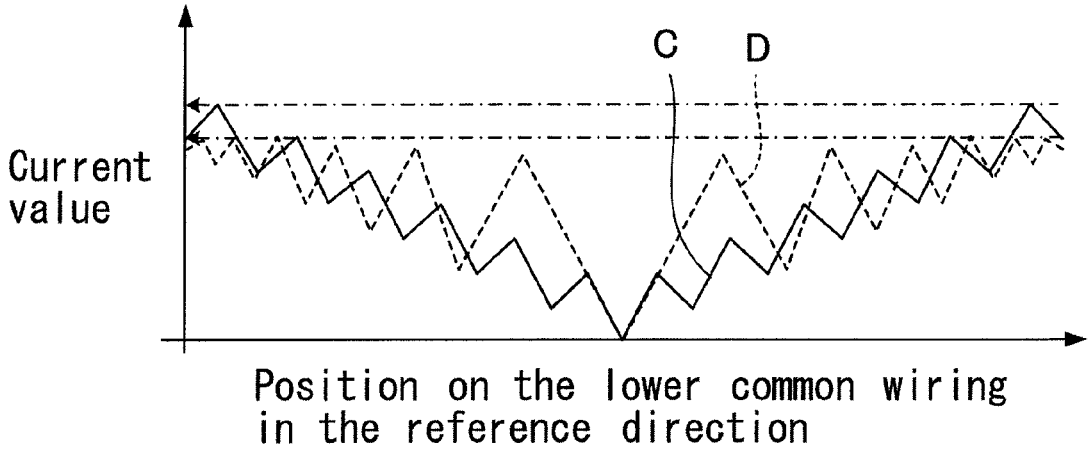

FIGS. 6A and 6B are views of the current value flowing in the lower common wiring 8 at a position on the lower common wiring 8 in the reference direction K in the liquid jet head 1 according to the second to fourth embodiments of the present invention. The position on the lower common wiring 8 in the reference direction K is shown on the horizontal axis. The current value flowing through the lower common wiring 8 is shown on the vertical axis. The smaller the current value is, the more the local concentration of the current on the lower common wiring 8 is softened. This can reduce the local heat generation on the lower common wiring 8. Note that the number of the through electrodes 10 is smaller than that of the common terminals 4.

FIG. 6A illustrates that the wiring resistance of the upper common wiring 9 in the reference direction K is sufficiently low to the lower common wiring 8. In that case, "the wiring resistance is sufficiently low" means that the wiring resistance is 1/10 or less (it is the same in the description below). The solid line graph A shows that the density of the installation of the through electrodes 10 in the reference direction K is approximately constant. The dotted line graph B shows that the density of the installation of the through electrodes 10 in the reference direction K increases from near the center of the sequence of the common terminals 4 in the reference direction K toward near both ends thereof. The numbers of the through electrodes 10 in the graph A and in the graph B are the same. The tops of each of the graphs show the positions of the through electrodes 10, and each of the bottoms shows the middle position between two through electrodes 10. As a result, the current value becomes highest near the center of the sequence of the common terminals 4 shown in the graph B. In other words, the concentration of the current occurs near the center of the sequence and the temperature of the generated heat becomes highest. Thus, when the upper common wiring 9 has a sufficiently low wiring resistance to the lower common wiring 8 in the reference direction K, it is preferable that the density of the installation of the through electrodes 10 in the reference direction K is approximately constant. The through electrodes 10 can be installed, for example, at intervals of a predetermined number of the common terminals 4.

FIG. 6B illustrates that the wiring resistance of the upper common wiring 9 in the reference direction K is not sufficiently low to the lower common wiring 8. The solid line graph C shows that the density of the installation of the through electrodes 10 in the reference direction K is approximately constant. The dotted line graph D shows that the density of the installation of the through electrodes 10 in the reference direction K increases from near the center of the sequence of the common terminals 4 in the reference direction K toward near both ends thereof. As a result, the current value becomes highest near both ends of the sequence of the common terminals 4 shown in the graph C. In other words, the concentration of the current occurs near both ends of the sequence and the temperature of the generated heat becomes highest. Thus, when the upper common wiring 9 does not have a sufficiently low wiring resistance to the lower common wiring 8 in the reference direction K, it is preferable that the density of the installation of the through electrodes 10 in the reference direction K near both ends of the sequence of the common terminals 4 is higher than near the center of the sequence.

(Fifth Embodiment)

Figure 7:
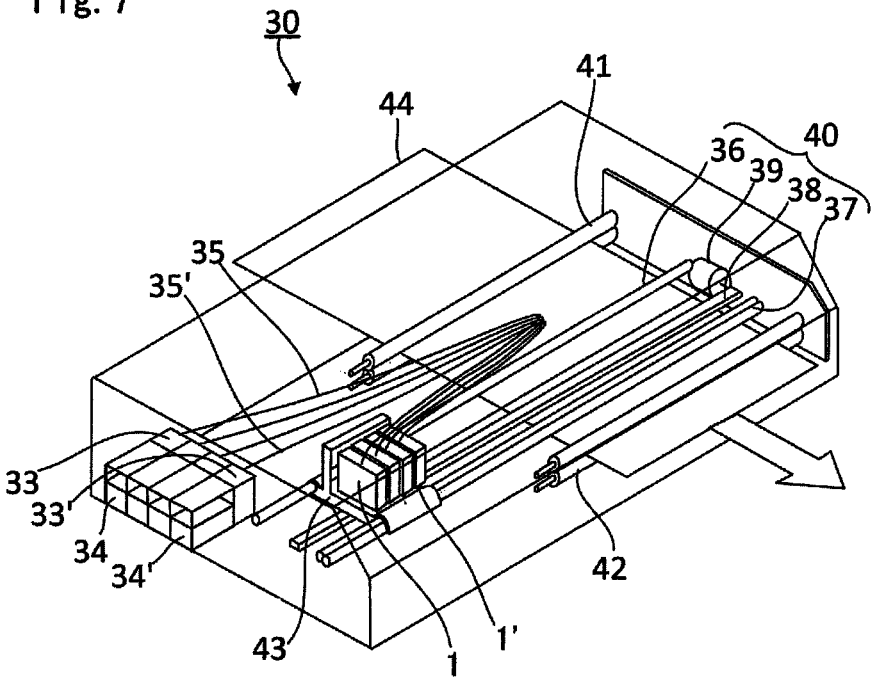
FIG. 7 is a schematic perspective view of a liquid jet apparatus according to a fifth embodiment of the present invention.
Figure 8:
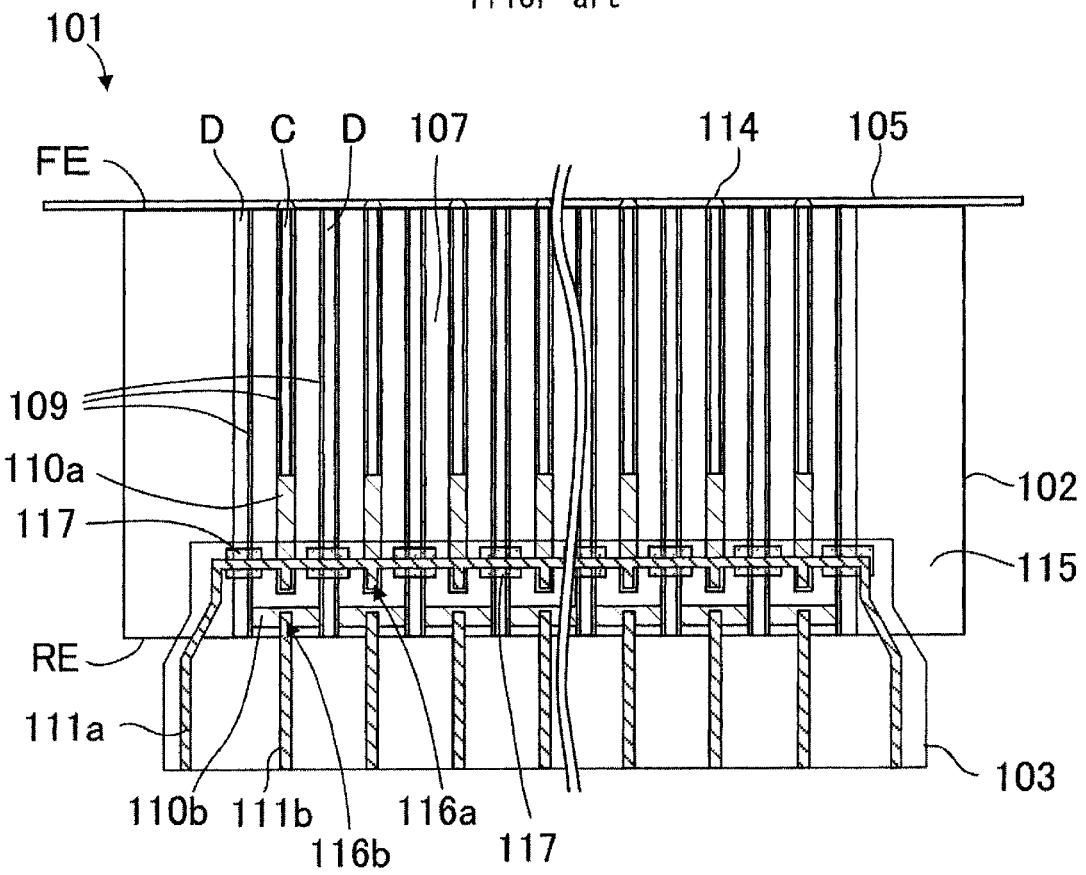
Fig. 8 Prior art
FIG. 8 is a schematic top view of a prior public-known liquid jet head from which the cover plate is removed.

FIG. 7 is a schematic perspective view of a liquid jet apparatus 30 according to the fifth embodiment of the present invention. The liquid jet apparatus 30 includes: a moving mechanism 40 configured to cause liquid jet heads 1 and 1' to reciprocate; flow path portions 35 and 35' configured to supply liquid to the liquid jet heads 1 and 1' and discharge the liquid from the liquid jet heads 1 and 1'; and liquid pumps 33 and 33' and liquid tanks 34 and 34' communicating with the flow path portions 35 and 35'. One or both of a supply pump configured to supply the liquid to the flow path portions 35 and 35' and a discharge pump configure to discharge the liquid can be installed as the liquid pumps 33 and 33'. This can circulate the liquid. Installing a pressure sensor or flow rate sensor (not illustrated in the drawings) can regulate the flow rate of the liquid. The liquid jet head 1 according to the first to fourth embodiments can be used as the liquid jet heads 1 and 1'. In other words, the liquid jet head 1 includes: a head chip 2 including a plurality of common terminals 4 arranged in the reference direction K; and a circuit board 3 connected to the head chip 2.

The liquid jet apparatus 30 includes: a pair of conveying units 41 and 42 configured to convey a recording medium 44 such as paper in a main scanning direction; the liquid jet heads 1 and 1' configured to jet liquid onto the recording medium 44; a carriage unit 43 placing the liquid jet heads 1 and 1' thereon; the liquid pumps 33 and 33' configured to supply the liquid stored in the liquid tanks 34 and 34' to the flow path portions 35 and 35' by pressing the liquid; and the moving mechanism 40 configured to scan the liquid jet heads 1 and 1' in a vertical scanning direction perpendicular to the main scanning direction. A control unit (not illustrated in the drawings) controls and drives the liquid jet heads 1 and 1', the moving mechanism 40, and the conveying units 41 and 42.

The pair of conveying units 41 and 42 extends in the vertical scanning direction, and includes a grid roller and pinch roller configured to rotate while the roller surfaces contact each other. A motor (not illustrated in the drawings) moves the grid roller and pinch roller by causing the rollers to rotate around the shafts to convey the recording medium 44 held between the rollers in the main scanning direction. The moving mechanism 40 includes: a pair of guide rails 36 and 37 extending in the vertical scanning direction; the carriage unit 43 slidable along the pair of guide rails 36 and 37; an endless belt 38 coupled to the carriage unit 43 and configured to move the carriage unit 43 in the vertical scanning direction; and a motor 39 configured to cause the endless belt 38 to revolve through a pulley (not illustrated in the drawings).

The carriage unit 43 places a plurality of liquid jet heads 1 and 1' thereon so as to jet four types of droplets, for example, yellow, magenta, cyan, and black. The liquid tanks 34 and 34' store corresponding color liquid and supply the liquid through the liquid pumps 33 and 33', and the flow path portions 35 and 35' to the liquid jet heads 1 and 1'. Each of the liquid jet heads 1 and 1' jets the droplets of which color corresponds to the drive signal. Controlling the timing to jet liquid from the liquid jet heads 1 and 1', the rotation of the motor 39 driving the carriage unit 43, and the speed at which the recording medium 44 is conveyed can record an arbitrary pattern on the recording medium 44.

Note that, although the liquid jet apparatus 30 of the present embodiment records information by moving the carriage unit 43 and the recording medium 44 using the moving mechanism 40, the liquid jet apparatus can record information by moving the recording medium two-dimensionally while fixing the carriage unit using the moving mechanism, alternatively. In other words, the moving mechanism may move the liquid jet head and the recording medium relatively.

What is claimed is:

1. A liquid jet head comprising:

a head chip including a plurality of common terminals arranged in a reference direction; and a circuit board connected to the head chip, the circuit board including:

a plurality of shared terminals installed on a lower surface on the head chip side and electrically connected to the common terminals, respectively;

an upper common wiring installed on a top surface opposite to the head chip side and extending in the reference direction;

a lower common wiring extending on the lower surface in the reference direction and electrically connected to the shared terminals; and a through electrode electrically connecting each of the shared terminals to the upper common wiring.

2. The liquid jet head according to claim 1, wherein:

the head chip includes a plurality of active terminals arranged parallel to the common terminals in the reference direction, the circuit board includes a plurality of individual terminals installed on the lower surface and arranged parallel to the shared terminals in the reference direction, and the active terminals are electrically connected to the individual terminals, respectively.

3. The liquid jet head according to claim 2, wherein the upper common wiring covers upper portions of the active terminals.

4. The liquid jet head according to claim 2, wherein:

ejection grooves and non-ejection grooves are alternately arranged on the head chip in the reference direction, the common terminals are electrically connected to drive electrodes installed on side surfaces of the ejection grooves, and each of the active terminals is electrically connected to a drive electrode installed on a side surface on an ejection groove side of two non-ejection grooves holding the ejection groove therebetween.

5. The liquid jet head according to claim 1, wherein an electrode width of the upper common wiring in a direction perpendicular to the reference direction is larger than an electrode width of the lower common wiring in a direction perpendicular to the reference direction.

6. The liquid jet head according to claim 1, wherein a cross-sectional area of the upper common wiring in a direction perpendicular to the reference direction is larger than a cross-sectional area of the lower common wiring in a direction perpendicular to the reference direction.

7. The liquid jet head according to claim 1, wherein a density of installation of the through electrodes in the reference direction near both ends of a sequence of the common terminals is higher than near a center of the sequence.

8. The liquid jet head according to claim 1, wherein a density of installation of the through electrodes in the reference direction is approximately constant.

9. The liquid jet head according to claim 1, wherein each of the through electrodes is installed on an intersection at which the shared terminal intersects the lower common wiring.

10. The liquid jet head according to claim 1, wherein:

the head chip includes a concavity between the common terminals and the active terminals, and the lower common wiring faces an upper end opening of the concavity.

11. The liquid jet head according to claim 1, wherein, in a planar view in a vertical direction of a substrate surface of the circuit board, the shared terminals protrude from the upper common wiring.

12. A liquid jet apparatus comprising:

the liquid jet head according to claim 1;

a moving mechanism configured to move the liquid jet head and a recording medium relatively;

a liquid supply pipe configured to supply liquid to the liquid jet head; and a liquid tank configured to supply the liquid to the liquid supply pipe.

13. The liquid jet head according to claim 1, wherein each of the shared terminals covers an area of the lower surface of the circuit board that is larger than an area of the lower surface of the circuit board covered by the through electrode.

14. The liquid jet head according to claim 1, wherein the upper common wiring is provided only on the top surface of the circuit board.

* * * * *